US009453464B2

(12) United States Patent
Kamada et al.

(10) Patent No.: US 9,453,464 B2
(45) Date of Patent: Sep. 27, 2016

(54) CONTROL DEVICE FOR VARIABLE-COMPRESSION-RATIO INTERNAL COMBUSTION ENGINE

(71) Applicant: NISSAN MOTOR CO., LTD., Yokohama-shi, Kanagawa (JP)

(72) Inventors: Shinobu Kamada, Yokohama (JP); Ryosuke Hiyoshi, Isehara (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 0 days.

(21) Appl. No.: 14/397,521

(22) PCT Filed: Apr. 3, 2013

(86) PCT No.: PCT/JP2013/060172
§ 371 (c)(1),
(2) Date: Oct. 28, 2014

(87) PCT Pub. No.: WO2013/172108
PCT Pub. Date: Nov. 21, 2013

(65) Prior Publication Data

US 2015/0122225 A1 May 7, 2015

(30) Foreign Application Priority Data

May 17, 2012 (JP) ..... 2012-112928

(51) Int. Cl.

| | |
|---|---|
| ***F02D 15/04*** | (2006.01) |
| ***F02D 41/14*** | (2006.01) |
| ***F02D 15/02*** | (2006.01) |
| ***F02D 41/30*** | (2006.01) |
| *F02D 35/02* | (2006.01) |

(52) U.S. Cl.
CPC ..... *F02D 15/04* (2013.01); *F02D 15/02* (2013.01); *F02D 41/1446* (2013.01); *F02D 41/3017* (2013.01); *F02D 35/027* (2013.01); *F02D 41/1454* (2013.01)

(58) Field of Classification Search
CPC ..... F02D 15/00; F02D 15/02; F02D 15/04; F02D 41/1446; F02D 41/3017
See application file for complete search history.

(56) References Cited

U.S. PATENT DOCUMENTS 4,661,234 A * 4/1987 Takahashi ..... G01N 27/4065 204/406
2011/0005207 A1* 1/2011 Akihisa ..... F01N 11/005 60/286

FOREIGN PATENT DOCUMENTS

| | | |
|---|---|---|
| JP | 2001-295624 A | 10/2001 |
| JP | 2004-060551 A | 2/2004 |
| JP | 2006-46194 | 2/2006 |

(Continued)

*Primary Examiner* — Lindsay Low
*Assistant Examiner* — Jacob Amick
(74) *Attorney, Agent, or Firm* — Drinker Biddle & Reath LLP

(57) ABSTRACT

A control device for a variable compression ratio internal combustion engine is equipped with a variable compression ratio device capable of changing an engine compression ratio of the internal combustion engine. The control device detects or estimates the temperature of an exhaust component (B11), and sets a target exhaust gas temperature based on the temperature of the exhaust component (B12). A mixing ratio and compression ratio set section (B13) sets a fuel mixing ratio and the engine compression ratio within such a range as not to exceed the target exhaust gas temperature such that energy loss becomes minimum.

7 Claims, 13 Drawing Sheets

(56) References Cited

FOREIGN PATENT DOCUMENTS

| | | | |
|---|---|---|---|
| JP | 2007-064153 | A | 3/2007 |
| JP | 2009-185669 | A | 8/2009 |
| JP | 2012-031839 | A | 2/2012 |
| JP | 2012-87717 | | 5/2012 |

* cited by examiner (A) HIGH COMPRESSION RATIO POSITION (B) LOW COMPRESSION RATIO POSITION

P2

CONTROL DEVICE FOR VARIABLE-COMPRESSION-RATIO INTERNAL COMBUSTION ENGINE

TECHNICAL FIELD

The present invention relates to control of an internal combustion engine equipped with a variable compression ratio device capable of changing an engine compression ratio of the internal combustion engine.

BACKGROUND ART

Conventionally, in a region such as a high rotation speed and high load region of an internal combustion engine, increase in amount of fuel or the like is performed in order to prevent excessive temperature rise in such an exhaust component as a catalyst, an exhaust pipe and the like beyond a limit value. In a technology of preventing such an excessive temperature rise in the exhaust component as recited in Patent Literature 1, in a variable compression ratio internal combustion engine equipped with a variable compression ratio device capable of changing an engine compression ratio, a value of increase in amount of fuel is set in accordance with the engine compression ratio. Specifically, as the engine compression ratio becomes higher, thermal efficiency is further enhanced and the temperature of exhaust gas is decreased. Therefore, the value of increase in amount of fuel is set such that as the engine compression ratio becomes higher, the value of increase in amount of fuel becomes smaller.

CITATION LIST

Patent Literature

Patent Literature 1: Japanese Patent Application Unexamined Publication No. 2009-185669

SUMMARY OF INVENTION

Technical Problem

However, when the increase in amount of fuel for protection of the exhaust component is performed in accordance with an engine operating condition that is determined from engine load, engine rotation speed, etc., there is a fear that deterioration of fuel economy and deterioration of the exhaust are caused due to execution of the increase in amount of fuel regardless of the fact that actually the temperature of the exhaust component is low.

Solution to Problem

The present invention was made in view of such circumstances. In the present invention, the temperature of the exhaust component is estimated or detected, a target exhaust gas temperature is set based on the temperature of the exhaust component, and a fuel mixing ratio relating to increase in amount of fuel and an engine compression ratio are set based on the target exhaust gas temperature such that energy loss is reduced within a range below the target exhaust gas temperature.

Effect of Invention

According to the present invention, the temperature of the exhaust component is detected or estimated, and a fuel mixing ratio and engine compression ratio are set based on the temperature of the exhaust component. With this configuration, it is possible to suppress execution of excessive increase in amount of fuel regardless of the fact that actually the temperature of the exhaust component is low. Further, fuel economy and exhaust performance can be enhanced by setting adequate combination of a fuel mixing ratio and an engine compression ratio in which energy loss is reduced.

DESCRIPTION OF EMBODIMENTS

Figure 1:
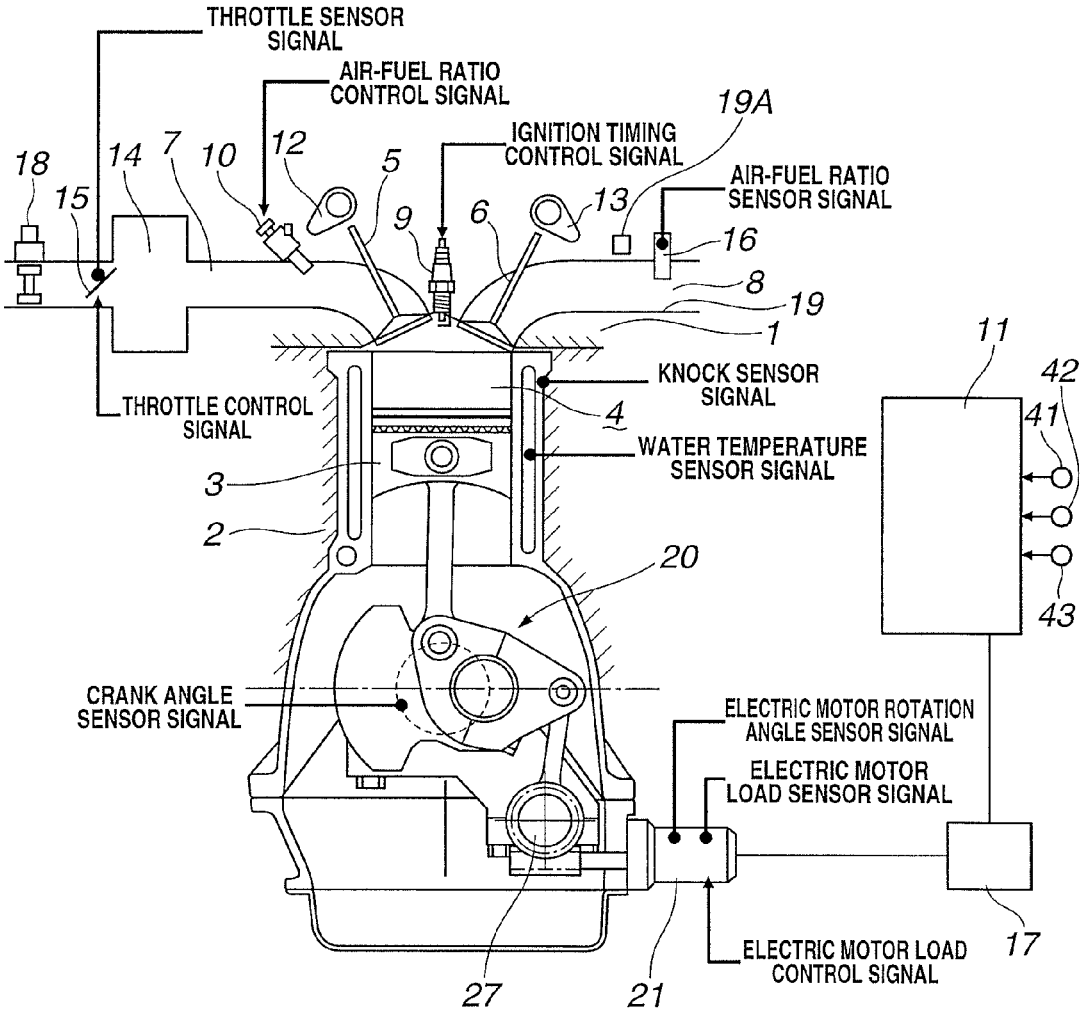
FIG. 1 is a system configuration diagram of a control device for a variable compression ratio internal combustion engine, according to an embodiment of the present invention.

In the following, a preferred embodiment of the present invention is explained with reference to the accompanying drawings. Referring to FIG. 1, there is shown an internal combustion engine mainly constituted of cylinder head 1 and cylinder block 2. The internal combustion engine is a spark ignition internal combustion engine such as a gasoline engine equipped with plug 9 that spark-ignites an air-fuel mixture in combustion chamber 4 defined above piston 3. As is well known, the internal combustion engine includes intake valve 5 that is driven to open and close intake port 7 by intake cam 12, exhaust valve 6 that is driven to open and close exhaust port 8 by exhaust cam 13, fuel injection valve 10 that injects fuel into intake port 7, and throttle 15 that adjusts an intake air amount by opening and closing an upstream side of intake collector 14. The internal combustion engine also includes variable compression ratio mechanism 20 as a variable compression ratio device capable of changing an engine compression ratio of the internal combustion engine. Incidentally, the present invention is not limited to such a port injection type internal combustion engine, and is applicable to an in-cylinder direct injection internal combustion engine in which fuel is directly injected into combustion chamber 4.

Control unit 11 is a known digital computer including CPU, ROM, RAM and I/O interface. Based on a signal or the like obtained from sensors as described below which indicates a vehicle operating condition, control unit 11 outputs a control signal to various actuators such as fuel injection valve 10, spark plug 9, throttle 15, and electric motor 21 of variable compression ratio mechanism 20, and generally controls a fuel injection amount, a fuel injection timing, an ignition timing, a throttle opening degree, and the engine compression ratio, etc.

There are provided various kinds of sensors for detecting a vehicle operating condition. The sensors include air-fuel ratio sensor 16 that is disposed in an exhaust passage and detects an air-fuel ratio of exhaust gas, air flow meter 18 that detects an intake air amount of the internal combustion engine, temperature sensor (exhaust component temperature detection section) 19A that is attached to exhaust manifold 19 as one of the exhaust components and detects the temperature of exhaust manifold 19, that is, the temperature of an exhaust component, knock sensor 41 that detects the presence or absence of knocking, coolant temperature sensor 42 that detects the engine coolant temperature, crank angle sensor 43 that detects a rotation speed of the internal combustion engine, and the like. In addition to sensor signals from these sensors, a rotation angle sensor signal, a load sensor signal and the like outputted from electric motor 21 that drives control shaft 27 of variable compression ratio mechanism 20 with electric power supplied from battery 17 are inputted to control unit 11.

Figure 2:
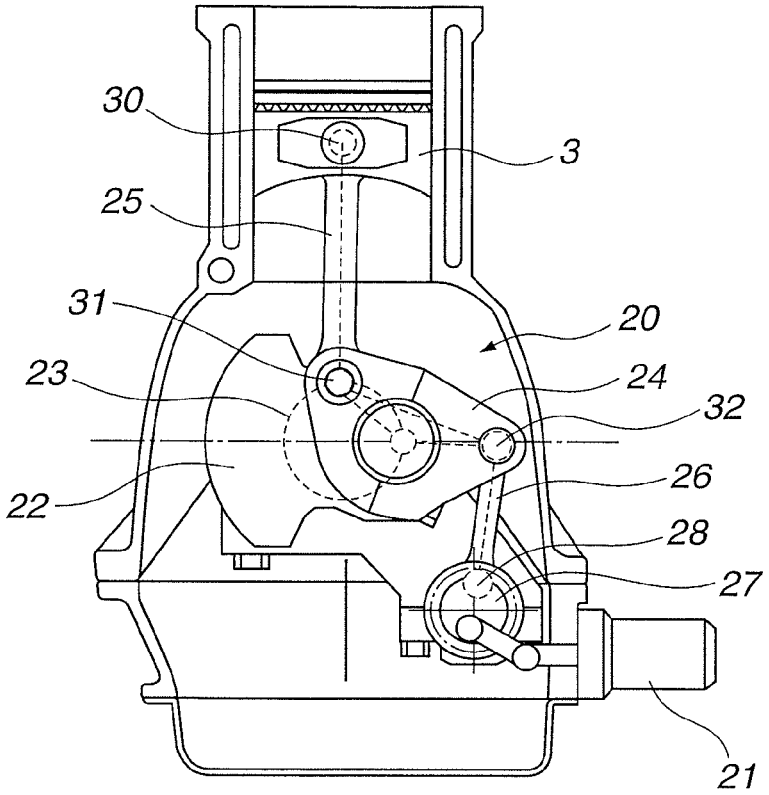
FIG. 2 is a configuration diagram showing a variable compression ratio mechanism of the embodiment.
Figure 3:
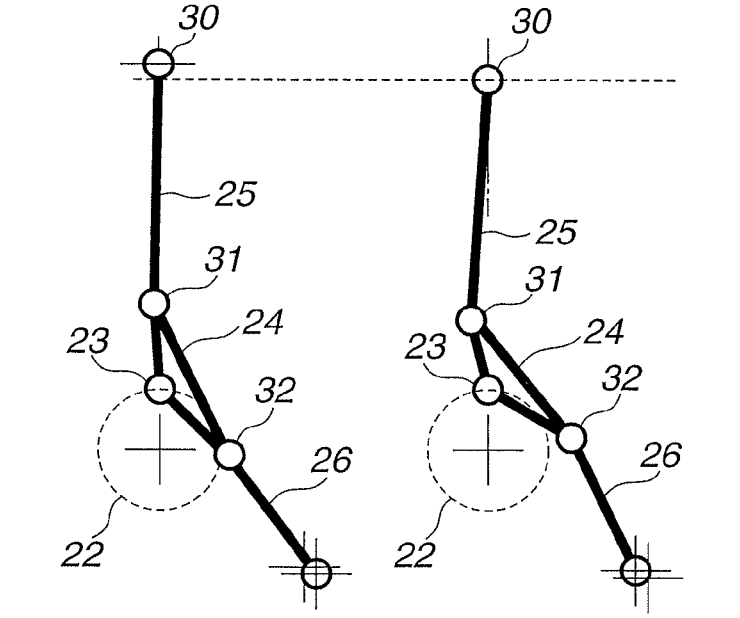
FIG. 3 is an explanatory diagram showing a link attitude in a high compression ratio position (A) of the variable compression ratio mechanism and a link attitude in a low compression ratio position (B) of the variable compression ratio mechanism.

Referring to FIG. 2 and FIG. 3, there is shown variable compression ratio mechanism 20 that utilizes a multi-link piston crank mechanism in which piston 3 and crank pin 23 of crankshaft 22 are connected to each other by a plurality of links. Variable compression ratio mechanism 20 includes lower link 24 rotatably mounted to crank pin 23, upper link 25 that connects lower link 24 and piston 3, control shaft 27 provided with eccentric shaft portion 28, and control link 26 that connects eccentric shaft portion 28 and lower link 24. Upper link 25 has one end rotatably attached to piston pin 30 and the other end rotatably connected with lower link 24 through first connecting pin 31. Control link 26 has one end rotatably connected with lower link 24 through second connecting pin 31 and the other end rotatably attached to eccentric shaft portion 28.

By changing a rotational position of control shaft 27 as a control member by electric motor 21, as also shown in FIG. 3, an attitude of lower link 24 is changed by control link 26 so that piston motion of piston 3 (stroke characteristics), that is, a change in top dead center position and bottom dead center position of piston 3 is produced to thereby continuously or stepwise change and control an engine compression ratio.

Figure 4:
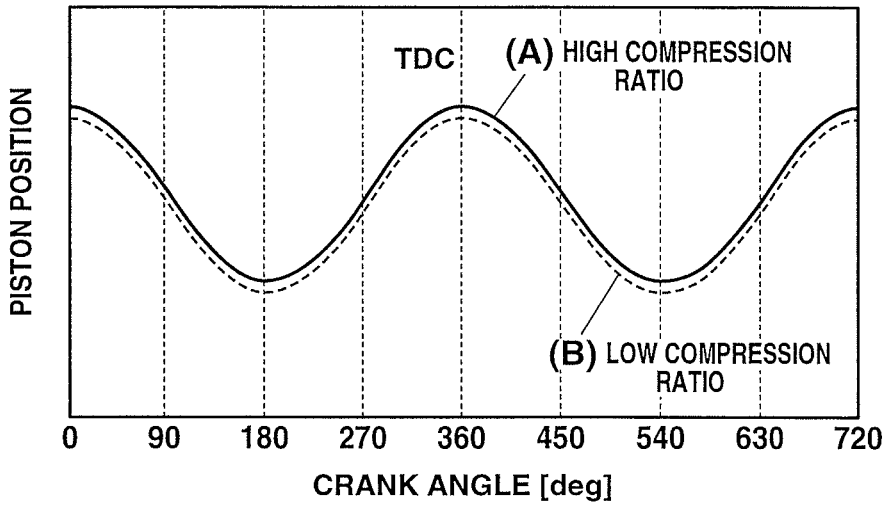
FIG. 4 is a characteristic diagram showing a piston motion in the high compression ratio position (A) of the variable compression ratio mechanism and a piston motion in the low compression ratio position (B) of the variable compression ratio mechanism.

With variable compression ratio mechanism 20 utilizing thus-configured multi-link piston crank mechanism, it is possible to enhance fuel economy and output by properly adjusting the engine compression ratio in accordance with an engine operating condition. In addition, it is possible to adjust piston stroke characteristics (see FIG. 4) per se to proper characteristics, for instance, characteristics close to simple harmonic oscillation in comparison with a single link piston-crank mechanism (a single link mechanism) in which a piston and a crankpin are connected by one link. Further, as compared to the single link mechanism, a piston stroke with respect to a crank throw can be increased to thereby reduce a total height of the engine and attain a high engine compression ratio. Further, by properly adjusting inclination of upper link 25, thrust load acting on piston 3 and the cylinder can be reduced to thereby reduce a weight of piston 3 and the cylinder. The actuator is not limited to electric motor 21 shown in the drawings, and may be other device, for instance, a hydraulic drive device using a hydraulic control valve.

Figure 5:
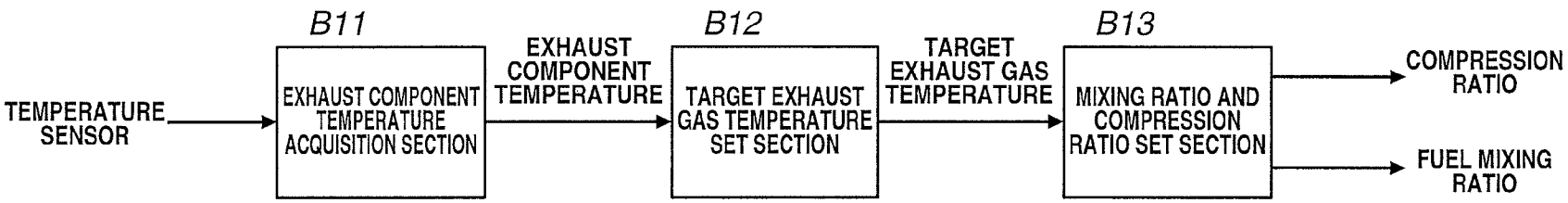
FIG. 5 is a control block diagram showing a flow of a process of setting a fuel mixing ratio and an engine compression ratio according to the embodiment.

FIG. 5 is a control block diagram showing a control process that is stored and executed by control unit 11 as functional blocks. Exhaust component temperature acquisition unit (exhaust component temperature acquisition section) B11 detects or estimates the temperature, of the exhaust component such as exhaust manifold 19, the catalyst, etc. For instance, the temperature of the exhaust component is directly detected by temperature sensor 19A disposed on exhaust manifold 19.

Target exhaust gas temperature setting unit (target exhaust gas temperature set section) B12 sets a target exhaust gas temperature based on the temperature of the exhaust component. Mixing ratio and compression ratio setting unit (mixing ratio and compression ratio set section) B13 sets an engine compression ratio and a fuel mixing ratio based on the target exhaust gas temperature.

Figure 6:
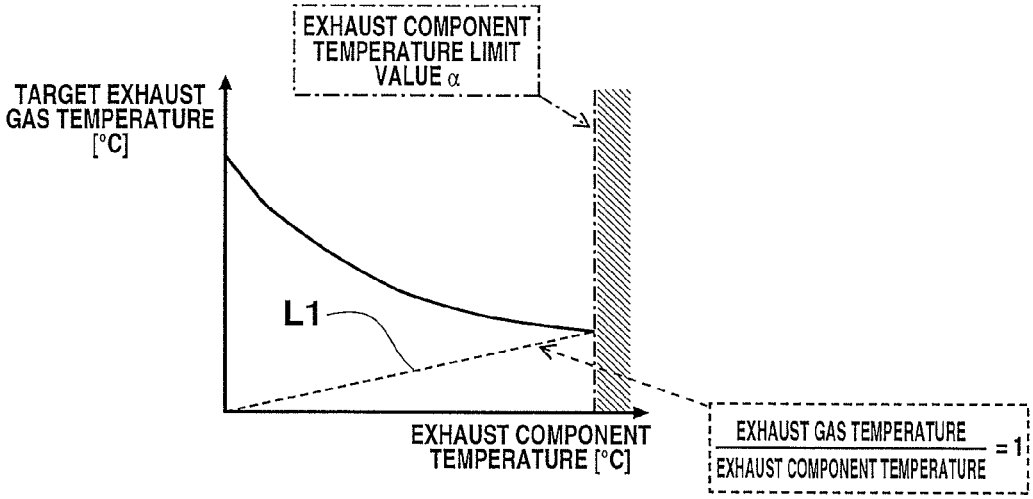
FIG. 6 is a characteristic diagram showing a relationship between an exhaust component temperature and a target exhaust gas temperature.
Figure 7:
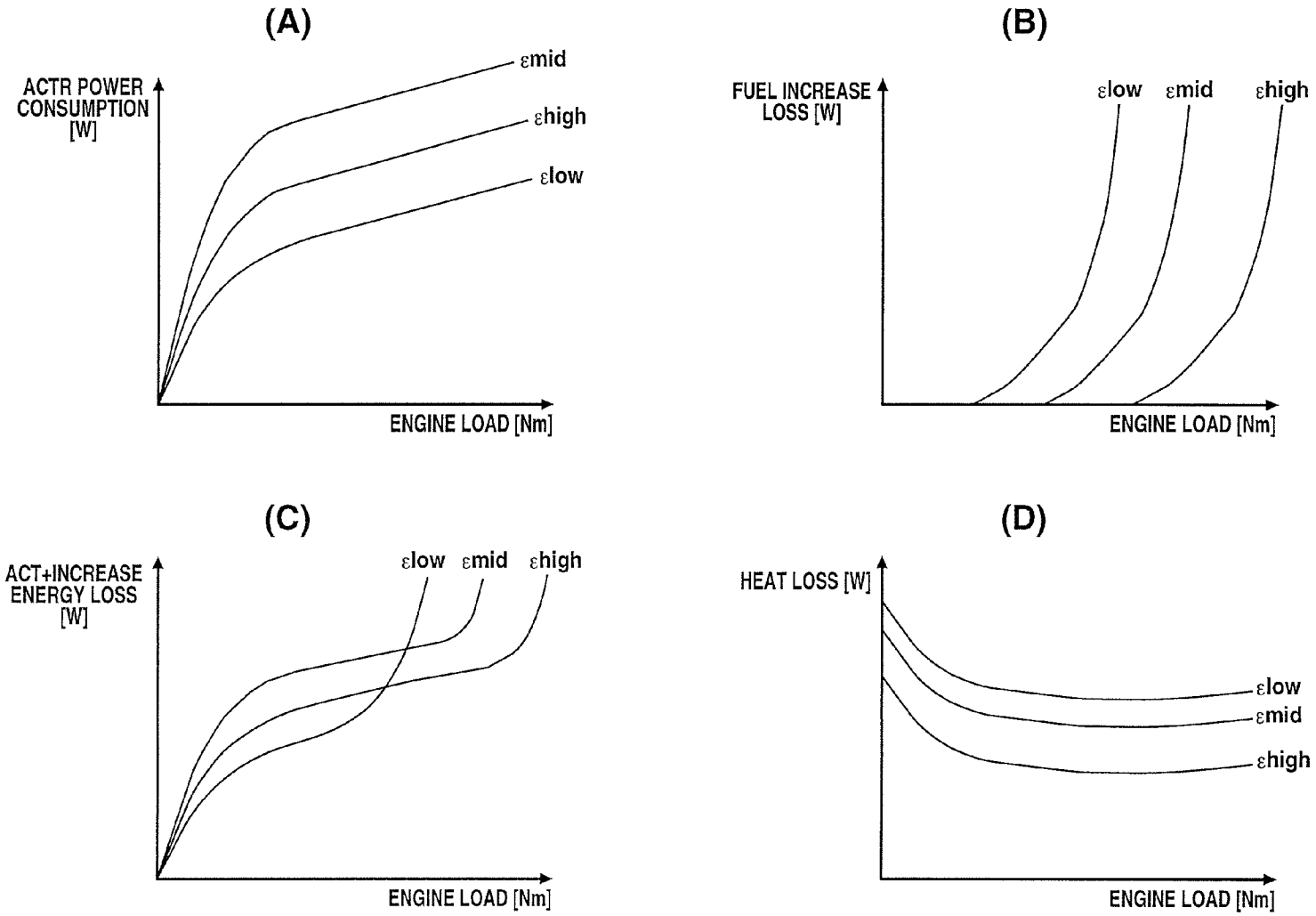
FIGS. 7(A)-(D) are explanatory diagrams showing variations in heat loss, etc. corresponding to respective engine loads in a low compression ratio setting condition, an intermediate compression ratio setting condition and a high compression ratio setting condition.

Next, by referring to FIG. 6 to FIGS. 12(A)-(B), setting of the engine compression ratio and an air-fuel ratio (A/F) as a parameter corresponding to the fuel mixing ratio (the mixing ratio of fuel and air) will be further explained. Referring to FIG. 6, a limit value $\alpha$ of the exhaust component temperature corresponds to a preset limit temperature of the exhaust component, and control is carried out such that the exhaust component temperature becomes equal to or lower than the limit value $\alpha$. In the present embodiment, as shown in FIG. 6, in a case where the exhaust component temperature is lower than the limit value $\alpha$ notwithstanding such an operating region as high rotation speed and high load region in which the exhaust component temperature is to be restricted to the limit value $\alpha$ or less in order to protect the exhaust component, the target exhaust gas temperature is set such that as the exhaust component temperature becomes lower, the target exhaust gas temperature is increased. In other words, the target exhaust gas temperature is set such that as the exhaust component temperature raises toward the limit value α, the target exhaust gas temperature is reduced toward the limit value α.

Further, broken line L1 shown in FIG. 6 indicates that a value of the exhaust gas temperature and a value of the exhaust component temperature are equal to each other (exhaust gas temperature/exhaust component temperature=1). As shown in FIG. 6, when the exhaust component temperature is lower than the predetermined limit value 痾, the target exhaust gas temperature is set on an upper side of line L1, that is, to a value higher than the exhaust component temperature, and set to a value higher than the limit value 痾.

The engine compression ratio is set in accordance with an engine operating condition that is basically determined from engine load and engine rotation speed. In a region on a low load side which is an ordinary operating region including a partial load region, the engine compression ratio is set to high compression ratio 蛩 high in order to enhance efficiency. When the high compression ratio 蛩 high is set, combustion pressure is increased and the reaction force is increased. Therefore, a link geometry of variable compression ratio mechanism 20 and the like are set such that power consumption (energy consumption) of electric motor 21 as an actuator is reduced as compared to setting of intermediate compression ratio 蛩 mid. Further, in a region on a high load side, the engine compression ratio is set to low compression ratio 蛩 low in order to suppress occurrence of knocking and reduce the exhaust gas temperature. Thus, when the frequently used low compression ratio 蛩 low is set, the link geometry of variable compression ratio mechanism 20 and the like are set such that the power consumption (energy consumption) of electric motor 21 as an actuator becomes minimum.

As a result, as shown in FIG. 7(A), in variable compression ratio mechanism 20, when the engine compression ratio is the intermediate compression ratio 蛩 mid, the power consumption of electric motor 21 as an actuator is increased as compared to a case in which the engine compression ratio is the high compression ratio 蛩 high or the low compression ratio 蛩 low. The intermediate compression ratio 蛩 mid is the engine compression ratio that is lower than the high compression ratio 蛩 high and higher than the low compression ratio 蛩 low.

On the other hand, as shown in FIG. 7(B), as the engine compression ratio becomes smaller, energy loss according to increase in amount of fuel is increased. Further, as shown in FIGS. 7(A), (B), regardless of setting of the engine compression ratio, as the engine load becomes higher, power consumption of the actuator and energy loss due to increase in amount of fuel are increased.

Based on the above description, as shown in FIG. 7(C), the engine compression ratio in which a total energy loss obtained as a sum of the power consumption of the actuator and the loss due to increase in amount of fuel becomes minimum varies in accordance with the engine load. On the low load side, when the engine compression ratio is set to the low compression ratio 蛩 low, the above-described energy loss becomes minimum. On the high load side, when the engine compression ratio is set to the high compression ratio 蛩 high, the above-described energy loss becomes minimum.

Figure 8:
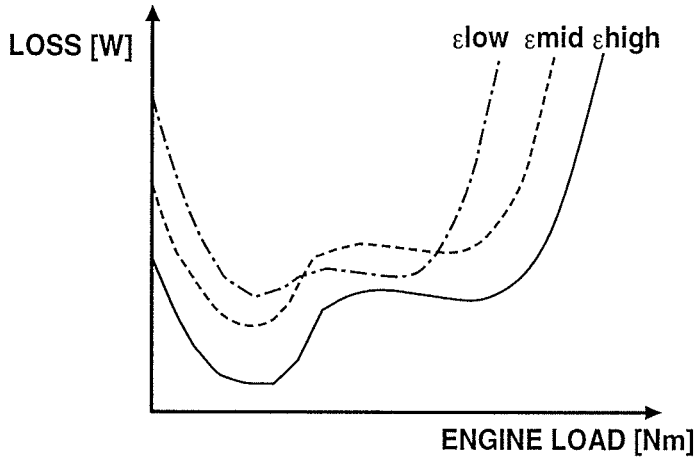
FIG. 8 is an explanatory diagram showing variations in total of energy loss corresponding to respective engine loads in a low compression ratio setting condition, an intermediate compression ratio setting condition and a high compression ratio setting condition.

Further, as shown in FIG. 7(D), as the engine compression ratio becomes smaller, heat loss caused in the exhaust system is increased, and as the engine load becomes smaller, the heat loss is increased. Accordingly, as shown in FIG. 8, a total energy loss obtained as a sum of the power consumption of the actuator, the loss due to increase in amount of fuel and the heat loss caused in the exhaust system complicatedly varies in accordance with setting of the engine compression ratio and the engine load.

In fact; a knock limit at which knocking occurs also varies in accordance with setting of the engine compression ratio. Therefore, in the consideration of the knock limit, as shown in FIG. 9, a settable engine compression ratio is limited in accordance with engine load.

Figure 9:
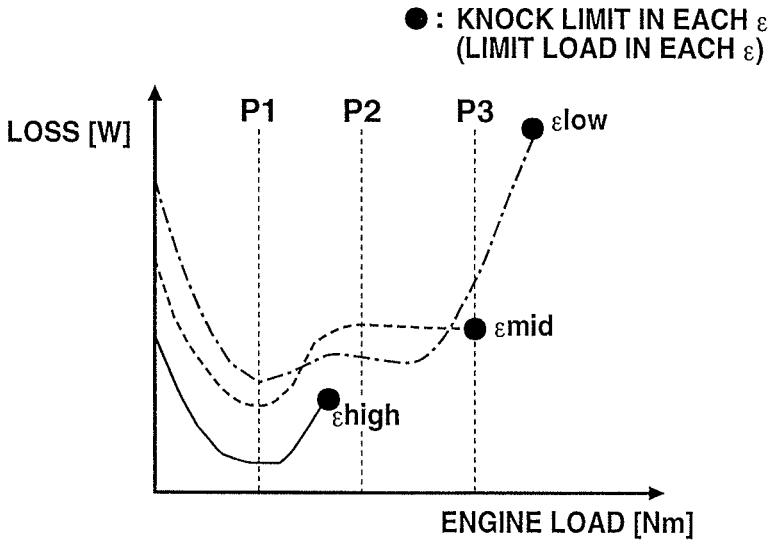
FIG. 9 is an explanatory diagram showing variations in total of energy loss corresponding to respective engine loads in a low compression ratio setting condition, an intermediate compression ratio setting condition and a high compression ratio setting condition in consideration of knock limit.
Figure 10:
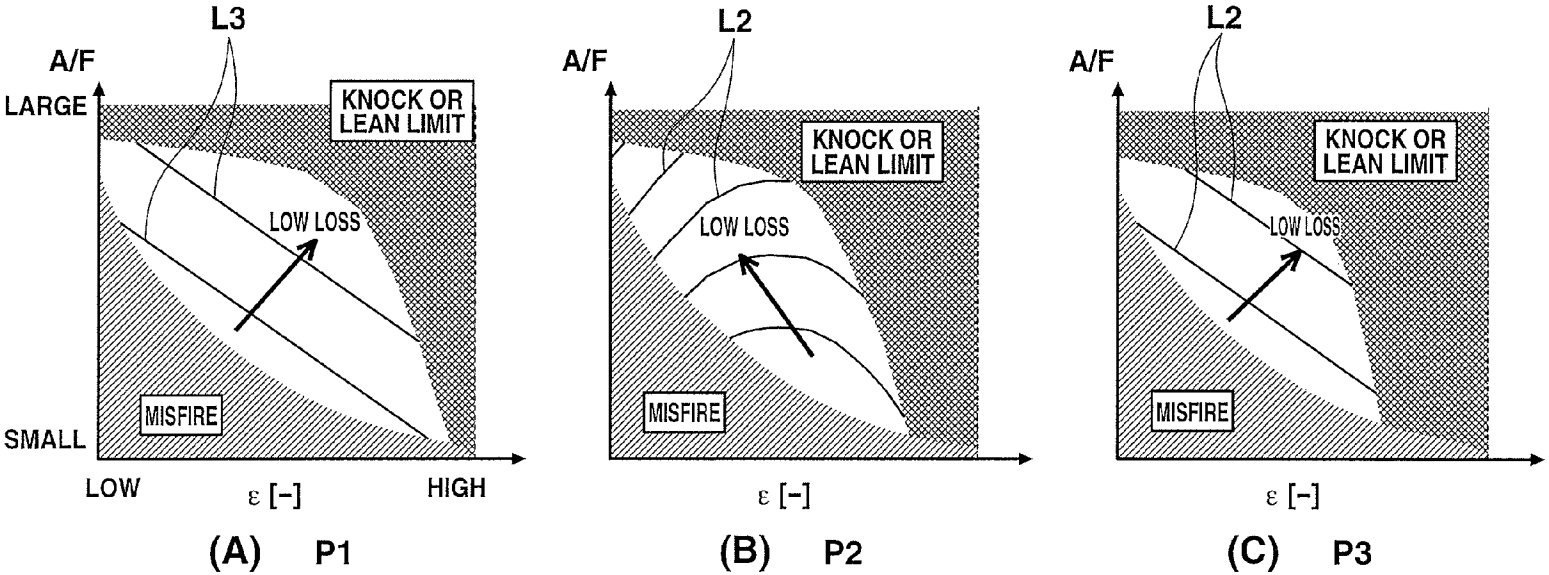
FIGS. 10(A)-(C) are characteristic diagrams showing energy loss relative to engine compression ratio and air-fuel ratio (mixing ratio) per engine load.
Figure 11:
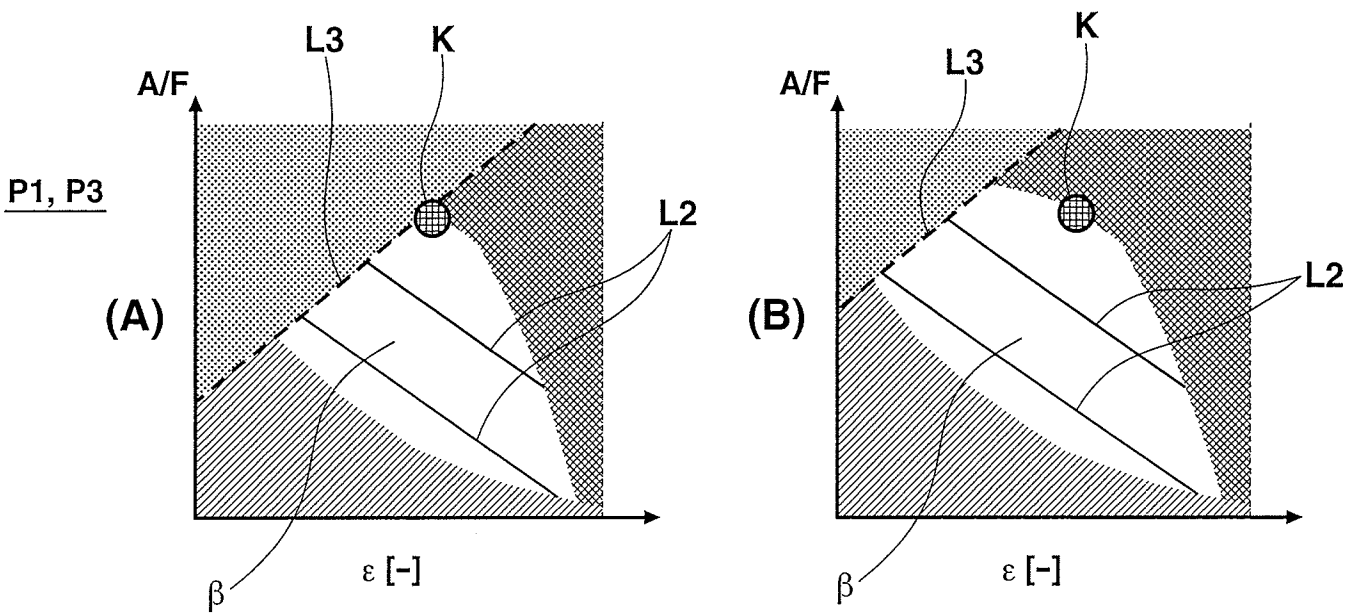
FIGS. 11(A)-(B) are characteristic diagrams showing energy loss relative to engine compression ratio and air-fuel ratio (mixing ratio) in consideration of target exhaust gas temperature, at a predetermined engine loads.
Figure 12:
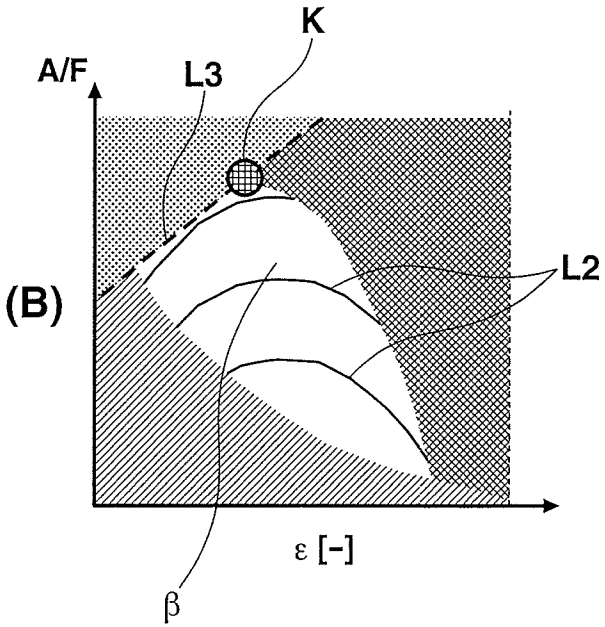
FIGS. 12(A)-(B) are characteristic diagrams showing energy loss relative to engine compression ratio and air-fuel ratio (mixing ratio) in consideration of target exhaust gas temperature, at an engine load different from those of FIGS. 11(A)-(B).
Figure 12:
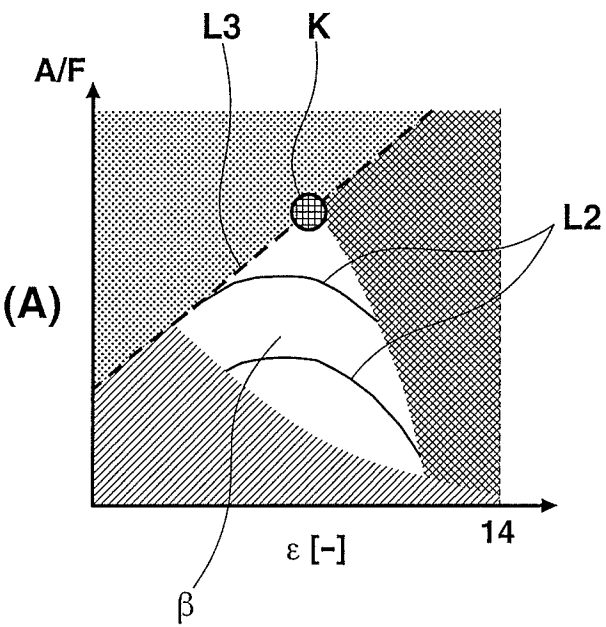

FIGS. 10(A)-(C) are maps showing a relationship between the total energy losses relative to combination of the engine compression ratio and the air-fuel ratio (A/F) at three predetermined engine load points P1, P2, P3 (see FIG. 9). In FIGS. 10(A)-(C), solid line L2 is a line extending through plots equal in the total energy loss (see FIG. 8 and FIG. 9). In FIGS. 10(A), (C), as the solid line L2 is directed toward the upper right side, the total energy loss decreases. In FIG. 10(B), as the solid line L2 is directed toward the upper left side, the total energy loss decreases. That is, a direction in which the total energy loss decreases varies in accordance with the engine load. Further, a lower left region in the drawings denotes a misfire region, and an upper right region therein denotes a knock or lean limit region. Setting of the engine compression ratio and the air-fuel ratio (A/F) is carried out in an intermediate region interposed between these regions (region in the drawing to which hatching is not applied).

Similarly to FIGS. 10(A), (C), FIGS. 11(A)-(B) are enlarged views of part of the maps corresponding to the above engine load points P1, P3. In FIGS. 11(A), (B), broken line L3 denotes a setting line for setting the engine compression ratio and the air-fuel ratio (A/F) based on the above target exhaust gas temperature. That is, a region located on a lower right side of the line L3 corresponds to such a range β as not to exceed the target exhaust gas temperature. It should be noted that the target exhaust gas temperature in FIG. 11(A) and the target exhaust gas temperature in FIG. 11(B) are different from each other. As shown in FIGS. 11(A), (B), combination K of the engine compression ratio and the air-fuel ratio (A/F) is set in the range β not more than the target exhaust gas temperature such that the total energy loss becomes minimum and a fuel consumption rate (an amount of fuel required to travel a predetermined distance) becomes minimum (that is, fuel economy becomes best).

Similarly to FIG. 10(B), FIGS. 12(A)-(B) are enlarged views of part of the maps corresponding to the above engine load point P2. In FIGS. 12(A)-(B), similarly to the case shown in FIGS. 11(A)-(B), combination K of the engine compression ratio and the air-fuel ratio is set in the range β not more than the target exhaust gas temperature such that the fuel consumption rate becomes minimum (that is, fuel economy becomes best).

Figure 13:
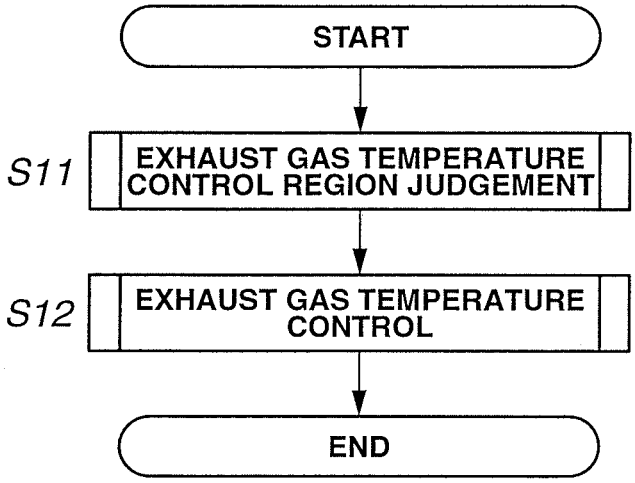
FIG. 13 is a flow chart showing a flow of a process of setting fuel mixing ratio and engine compression ratio according to the present invention.
Figure 14:
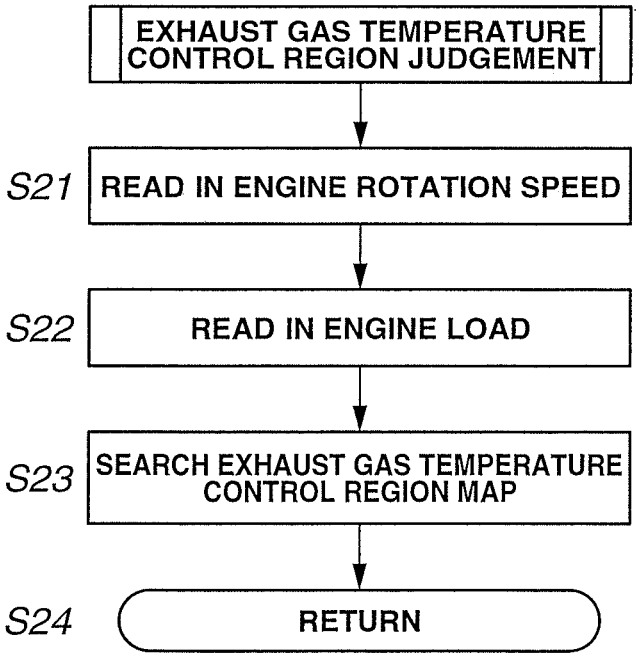
FIG. 14 is a flow chart showing a subroutine of judgment of an exhaust temperature control region shown in FIG. 13.

FIG. 13 is a flow chart showing a flow of a process of setting the air-fuel ratio and the engine compression ratio as described above. This routine is stored in and executed by the above-described control unit 11. In step S11, a subroutine of judgment of an exhaust temperature control region shown in FIG. 14 is executed. In subsequent step S12, a subroutine of exhaust gas temperature control as shown in FIG. 15 is executed based on a result of the judgment of an exhaust gas temperature control region.

FIG. 14 shows a process of the judgment of an exhaust gas temperature control region in the above-described step S11. In step S21, an engine rotation speed is read in. In step S22, a engine load is read in. Then, in step S23, based on the engine rotation speed and the engine load, the map of the exhaust gas temperature control region is searched, and an exhaust gas temperature control flag is set. That is, in a case where the current operating region is an operating region in which the exhaust gas temperature control is to be performed, specifically, as shown in FIG. 6, in an operating region in which the exhaust component temperature must be restricted to the limit value 痾 or less in order to protect the exhaust component, the exhaust gas temperature control flag is set to "1". In a case where the current operating region is not the operating region in which the exhaust gas temperature control is to be performed, the exhaust gas temperature control flag is set to "0".

Figure 15:
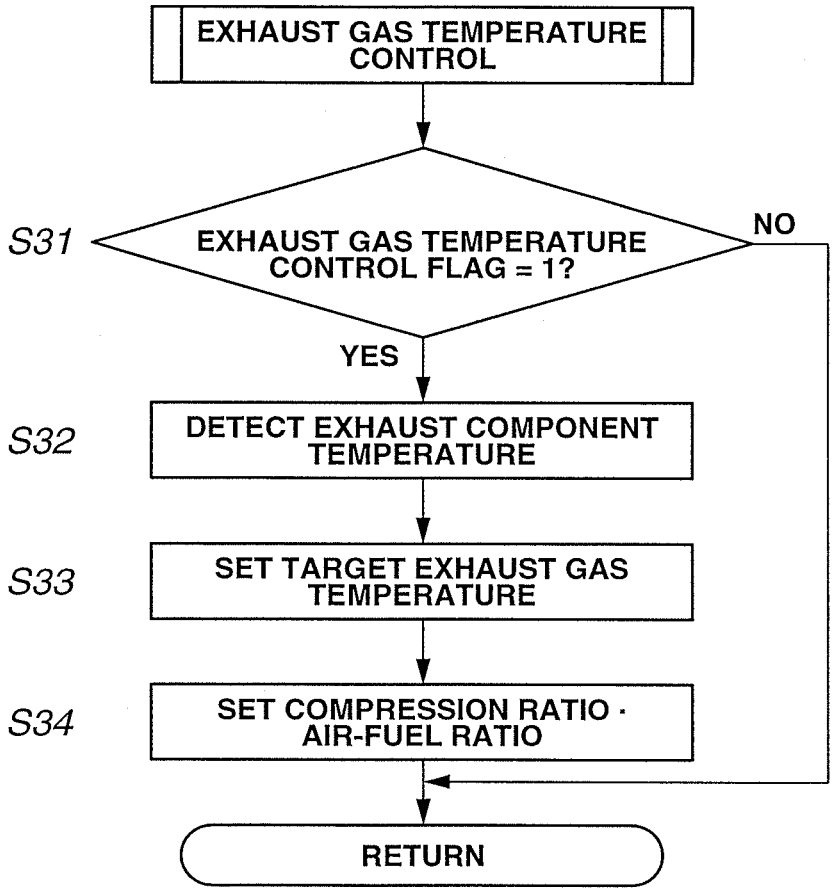
FIG. 15 is a flow chart showing a subroutine of exhaust temperature control shown in FIG. 13.

FIG. 15 shows a process of the exhaust gas temperature control in the above-described step S12. In step S31, it is judged whether or not the exhaust gas temperature control flag described above is "1", that is, whether or not the current operating region is the operating region in which the exhaust gas temperature control is to be performed. In a case where the exhaust gas temperature control flag is not "1", this routine is ended. In a case where the exhaust gas temperature control flag is "1", the logic flow proceeds to step S32. In step S32, the exhaust component temperature is detected or estimated. In step S33, a target exhaust gas temperature is set based on the exhaust component temperature. Then, in step S34, an engine compression ratio and an air-fuel ratio (a fuel mixing ratio) are set based on the target exhaust gas temperature, the engine load and the engine rotation speed.

Figure 16:
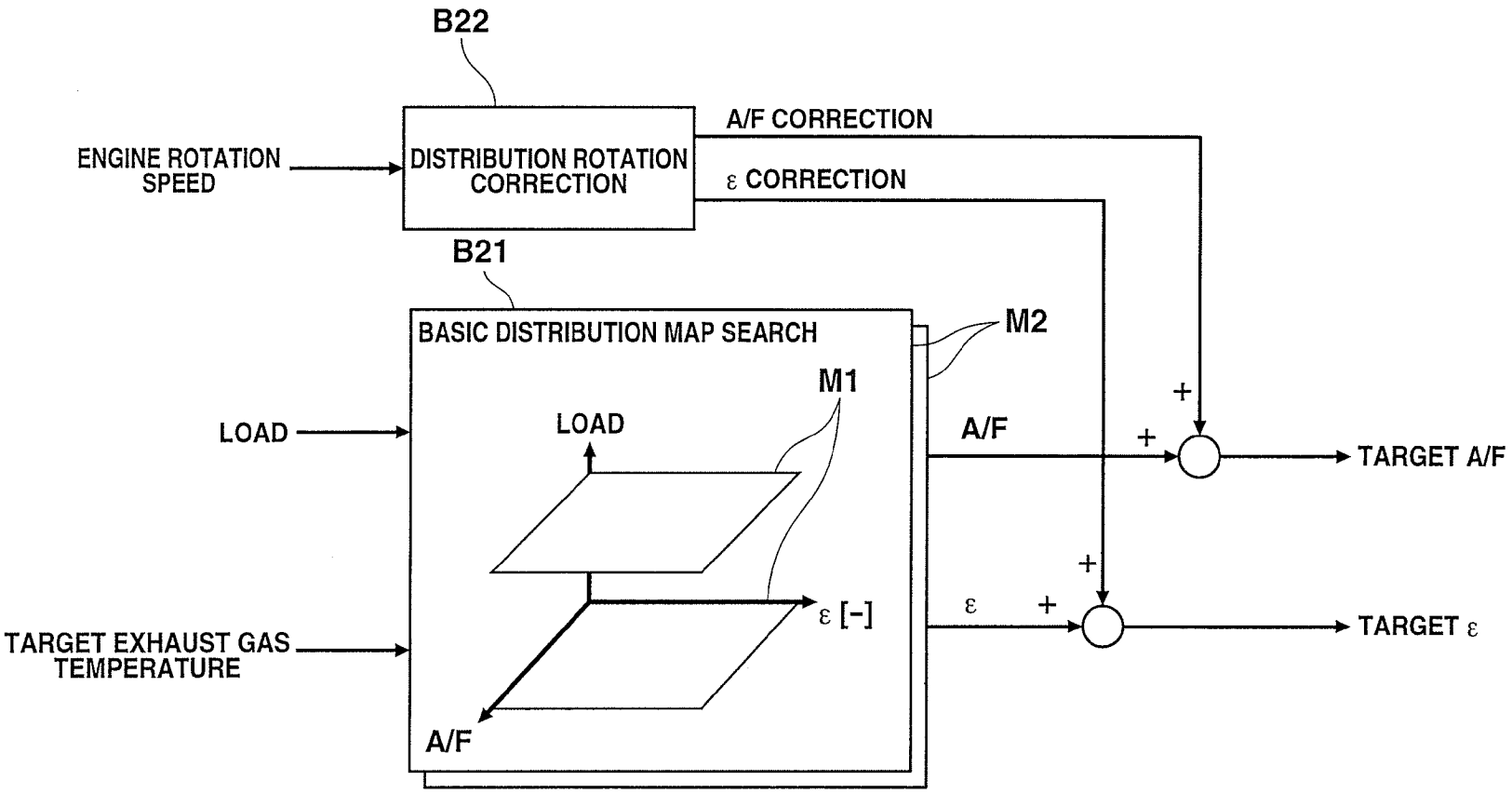
FIG. 16 is an explanatory diagram showing a flow of the process of setting fuel mixing ratio and engine compression ratio according to the present invention.

Such a process of setting of the air-fuel ratio and the engine compression ratio will be further explained by referring to FIG. 16. In basic distribution map set section B21, a plurality of basic distribution maps for setting the air-fuel ratio and the engine compression ratio as shown in FIGS. 11(A)-(B) and FIGS. 12(A)-(B) are previously stored in such a manner as to correspond to a plurality of engine loads (M1) and a plurality of the target exhaust gas temperatures, respectively. The basic distribution map to be used in the setting is searched based on an engine load and a target exhaust gas temperature which are inputted. Then, by referring to the basic distribution map searched, the combination of the air-fuel ratio (target A/F) and the engine compression ratio (target s) in which the total energy loss becomes minimum in such a range β as not to exceed the target exhaust gas temperature is set as described above with reference to FIGS. 11(A)-(B) and FIGS. 12(A)-(B).

Although in this embodiment, the target exhaust gas temperature is stepwise set as a plurality of values, the target exhaust gas temperature may be set as a continuous value.

Further, in the partition rotation correction section B22, the air-fuel ratio and the engine compression ratio are corrected based on the engine rotation speed. Specifically, as the engine rotation speed becomes higher, the air-fuel ratio is reduced and the engine compression ratio is increased so as to suppress rise in exhaust gas temperature.

Specific configurations and functions and effects of the configuration which can be grasped from the above embodiment are described below.

[1] The control device for a variable compression ratio internal combustion engine includes variable compression ratio mechanism 20 that can change an engine compression ratio of the internal combustion engine, and detects or estimates the temperature of an exhaust component. The control device sets a target exhaust gas temperature based on the exhaust component temperature, and sets a fuel mixing ratio of fuel and air (air-fuel ratio) and an engine compression ratio within such a range 竈 as not to exceed the target exhaust gas temperature, such that an energy loss is rendered as small as possible. Thus, the fuel mixing ratio and the engine compression ratio are set based on the actual exhaust component temperature, and therefore, it is possible to suppress excessive implementation of an increase in amount of fuel in spite of the fact that the actual exhaust component temperature is low, and set appropriate combination of the fuel mixing ratio and the engine compression ratio in which the energy loss is reduced. As a result, fuel economy performance and exhaust performance can be enhanced.

[2] Although the operating region is an operating region in which the exhaust component temperature is to be restricted to the predetermined limit value or less in order to protect the exhaust component, in a case where the exhaust component temperature is lower than the limit value α, as the exhaust component temperature becomes lower, the target exhaust gas temperature is set higher as shown in FIG. 6. In other words, the target exhaust gas temperature is set such that as the exhaust component temperature increases toward the limit value α, the target exhaust gas temperature is decreased toward the limit value α. That is, in a case where an actual exhaust component temperature is lower than the limit value α, there is no possibility that the exhaust component temperature immediately exceeds the limit value α even if the exhaust gas temperature becomes higher than the limit value α. Therefore, as the exhaust component temperature is lower, in other words, as an allowance until the exhaust component temperature increases up to the limit value α is larger, the target exhaust gas temperature is set higher. With this configuration, the actual exhaust component temperature can be restricted to the limit value α or less, and the range β not more than the target exhaust gas temperature can also be expanded to increase a degree of freedom of setting of the fuel mixing ratio and the engine compression ratio so that the fuel economy performance and the exhaust performance can be further enhanced.

[3] Specifically, in a case where the operating region is an operating region in which the exhaust component temperature is to be restricted to the predetermined limit value 痾 or less, and the exhaust component temperature is lower than the limit value 痾, the target exhaust gas temperature is set higher than the exhaust component temperature as shown in FIG. 6.

[4] Further, in a case where the operating region is an operating region in which the exhaust component temperature is to be restricted to the predetermined limit value 痾 or less, and the exhaust component temperature is lower than the limit value 痾, the target exhaust gas temperature is set higher than the limit value 痾 as shown in FIG. 6.

[5] More specifically, combination of the fuel mixing ratio and the engine compression ratio is set in accordance with the engine load in such a range 竈 as not to exceed the target exhaust gas temperature, such that the energy loss according to the engine load becomes minimum. With this configuration, it is possible to more appropriately set the fuel mixing ratio and the engine compression ratio in accordance with the engine load.

[6] Variable compression ratio mechanism 20 changes the engine compression ratio in accordance with a rotational position of control shaft 27 as a control member which is driven by electric motor 21 as an actuator. Variable compression ratio mechanism 20 is configured such that when the engine compression ratio is the intermediate compression ratio 蚤 mid, energy consumption of the actuator is increased in comparison with a case in which the engine compression ratio is the high compression ratio 蚤 high and a case in which the engine compression ratio is the low compression ratio 蛩 low. That is, upon setting the high compression ratio 蛩 high to be used in the low load side operating region that is an ordinary region and setting the low compression ratio 蛩 low to be used in the high load region, the energy consumption of the actuator is allowed to relatively decrease so that energy consumption can be reduced, thereby serving to enhance fuel economy and downsize the actuator.

However, in a case where variable compression ratio mechanism 20 is thus configured such that in the intermediate compression ratio 蛩 mid, the energy consumption of the actuator is increased, a relationship between a total energy loss including the energy consumption of the actuator, etc. and setting of the engine compression ratio and the fuel mixing ratio is not made simple, and for instance, as shown in FIG. 8 and FIG. 9, the engine compression ratio at which the total energy loss becomes minimum is changed in accordance with the engine load. In view of such circumstances, optimum combination of the mixing ratio and the engine compression ratio is set for each engine load.

[7] Since as the temperature of electric motor 21 as the actuator becomes lower, the power consumption is increased, the fuel mixing ratio and the engine compression ratio are preferably corrected in accordance with an operating condition of the actuator such as the actuator temperature and the like. With this configuration, it is possible to estimate the energy consumption of the actuator with high accuracy in consideration of the operating condition of the actuator. As a result, accuracy in setting of the combination of the mixing ratio and the engine compression ratio in which the total energy loss becomes minimum can be enhanced.

[8] Further, although in the above-described embodiment, the exhaust component temperature is detected using temperature sensor 19 for exclusive use, the exhaust component temperature may be estimated based on a power consumption of a heater (exhaust component temperature acquisition section) built in air-fuel ratio sensor 16, in order to simplify the configuration.

The invention claimed is:

1. A control device for a variable compression ratio internal combustion engine equipped with a variable compression ratio device configured to change an engine compression ratio of the internal combustion engine, the control device comprising:

an exhaust component temperature acquisition section that detects or estimates a temperature of an exhaust component;

a target exhaust gas temperature set section that sets a target exhaust gas temperature based on the temperature of the exhaust component; and a mixing ratio and compression ratio set section that sets a fuel mixing ratio of fuel and air and the engine compression ratio within such a range as not to exceed the target exhaust gas temperature such that energy loss is reduced, by referring to a stored basic distribution map based on at least the target exhaust gas temperature, wherein in a case where an operating region is an operating region in which the temperature of the exhaust component is to be restricted to a predetermined limit value or less, and the temperature of the exhaust component is lower than the limit value, the target exhaust gas temperature set section sets the target exhaust gas temperature higher as the temperature of the exhaust component becomes lower.

2. A control device for a variable compression ratio internal combustion engine equipped with a variable compression ratio device configured to change an engine compression ratio of the internal combustion engine, the control device comprising:

an exhaust component temperature acquisition section that detects or estimates a temperature of an exhaust component;

a target exhaust gas temperature set section that sets a target exhaust gas temperature based on the temperature of the exhaust component; and a mixing ratio and compression ratio set section that sets a fuel mixing ratio of fuel and air and the engine compression ratio within such a range as not to exceed the target exhaust gas temperature such that energy loss is reduced, by referring to a stored basic distribution map based on at least the target exhaust gas temperature, wherein in a case where an operating region is an operating region in which the temperature of the exhaust component is to be restricted to a predetermined limit value or less, and the temperature of the exhaust component is lower than the limit value, the target exhaust gas temperature set section sets the target exhaust gas temperature higher than the temperature of the exhaust component.

3. A control device for a variable compression ratio internal combustion engine equipped with a variable compression ratio device configured to change an engine compression ratio of the internal combustion engine, the control device comprising:

an exhaust component temperature acquisition section that detects or estimates a temperature of an exhaust component;

a target exhaust gas temperature set section that sets a target exhaust gas temperature based on the temperature of the exhaust component; and a mixing ratio and compression ratio set section that sets a fuel mixing ratio of fuel and air and the engine compression ratio within such a range as not to exceed the target exhaust gas temperature such that energy loss is reduced, by referring to a stored basic distribution map based on at least the target exhaust gas temperature, wherein in a case where an operating region is an operating region in which the temperature of the exhaust component is to be restricted to a predetermined limit value or less, and the temperature of the exhaust component is lower than the limit value, the target exhaust gas temperature set section sets the target exhaust gas temperature higher than the limit value.

4. A control device for a variable compression ratio internal combustion engine equipped with a variable compression ratio device configured to change an engine compression ratio of the internal combustion engine, the control device comprising:

an exhaust component temperature acquisition section that detects or estimates a temperature of an exhaust component;

a target exhaust gas temperature set section that sets a target exhaust gas temperature based on the temperature of the exhaust component; and a mixing ratio and compression ratio set section that sets a fuel mixing ratio of fuel and air and the engine compression ratio within such a range as not to exceed the target exhaust gas temperature such that energy loss is reduced, by referring to a stored basic distribution map based on at least the target exhaust gas temperature, wherein the mixing ratio and compression ratio set section sets combination of the fuel mixing ratio and the engine compression ratio within the range not exceeding the target exhaust gas temperature such that energy loss according to an engine load becomes minimum, based on the target exhaust gas temperature and the engine load.

5. A control device for a variable compression ratio internal combustion engine equipped with a variable compression ratio device configured to change an engine compression ratio of the internal combustion engine, the control device comprising:

an exhaust component temperature acquisition section that detects or estimates a temperature of an exhaust component;

a target exhaust gas temperature set section that sets a target exhaust gas temperature based on the temperature of the exhaust component; and a mixing ratio and compression ratio set section that sets a fuel mixing ratio of fuel and air and the engine compression ratio within such a range as not to exceed the target exhaust gas temperature such that energy loss is reduced, by referring to a stored basic distribution map based on at least the target exhaust gas temperature, wherein the variable compression ratio device changes the engine compression ratio in accordance with a position of a control member that is driven by an actuator, and the variable compression ratio device is configured such that when the engine compression ratio is an intermediate compression ratio, energy consumption of the actuator is increased in comparison with a case in which the engine compression ratio is a high compression ratio higher than the intermediate compression ratio and a case in which the engine compression ratio is a low compression ratio lower than the intermediate compression ratio.

6. The control device for a variable compression ratio internal combustion engine as claimed in claim 5, wherein the mixing ratio and compression ratio set section corrects the fuel mixing ratio and the engine compression ratio in accordance with an operating condition of the actuator.

7. The control device for a variable compression ratio internal combustion engine as claimed in claim 1, further comprising an air-fuel ratio sensor mounted to an exhaust pipe that is the exhaust component, the air-fuel ratio sensor detecting an air-fuel ratio of exhaust gas, wherein the exhaust component temperature acquisition section estimates the temperature of the exhaust component based on power consumption of a heater built in the air-fuel ratio sensor.

* * * * *